US005399403A

United States Patent [19]

Instance

[11] Patent Number: 5,399,403

[45] Date of Patent: Mar. 21, 1995

[54] LABELS AND MANUFACTURE THEREOF

[76] Inventor: David J. Instance, Guinea Hall, Sellindge, Kent TN25 6EG, United Kingdom

[21] Appl. No.: 974,596

[22] PCT Filed: Aug. 30, 1991

[86] PCT No.: PCT/GB91/01471

§ 371 Date: Feb. 26, 1993

§ 102(e) Date: Feb. 26, 1993

[87] PCT Pub. No.: WO92/04703

PCT Pub. Date: Mar. 19, 1992

[30] Foreign Application Priority Data

Aug. 31, 1990 [GB] United Kingdom ..... 9019032

[51] Int. Cl.[6] ..... B31D 1/02; G09F 3/02

[52] U.S. Cl. ..... 428/40; 156/253; 156/267; 156/268; 156/269; 156/270; 156/290; 156/291; 156/299; 156/300; 156/301; 156/303; 281/2; 281/5; 283/83; 428/124; 428/126; 428/130; 428/192; 428/194; 428/195

[58] Field of Search ..... 428/40, 77, 41, 124, 428/125, 42, 130, 192, 194, 195; 283/81; 281/215; 156/277, 253, 268, 270, 267, 269, 290, 291, 299-301, 303

[56] References Cited

U.S. PATENT DOCUMENTS

| | | | |
|---|---|---|---|
| 2,246,984 | 6/1941 | Palmer | 40/2 |
| 4,285,999 | 8/1981 | Olivieri et al. | 428/40 |
| 4,744,591 | 5/1988 | Instance | 283/81 |
| 4,991,878 | 12/1991 | Cowan | 283/81 |

FOREIGN PATENT DOCUMENTS

| | | |
|---|---|---|
| 0130053 | 1/1985 | European Pat. Off. . |
| 0140420 | 5/1985 | European Pat. Off. . |
| 0161914 | 11/1985 | European Pat. Off. . |
| 0180365 | 5/1986 | European Pat. Off. . |
| 0192444 | 8/1986 | European Pat. Off. . |
| 0195427 | 9/1986 | European Pat. Off. . |
| 0232054 | 8/1987 | European Pat. Off. . |
| 0283064 | 9/1988 | European Pat. Off. . |
| 2133343 | 7/1984 | United Kingdom . |
| 2166109 | 4/1986 | United Kingdom . |
| 2199010 | 6/1988 | United Kingdom . |
| 9002395 | 3/1990 | WIPO . |
| 9005631 | 5/1990 | WIPO . |
| 9104850 | 4/1991 | WIPO . |
| 9104851 | 4/1991 | WIPO . |

OTHER PUBLICATIONS

"Examiner's report to the Comptroller under Section 17 (The Search Report)" dated 18 Oct. 1990 (search report issued on UK Appln. 9019032.3).

"International Search Report" dated 11 Dec. 1991 (EPO search report issued on International Appln. PCT/GB 91/01471).

*Primary Examiner*—Nasser Ahmad

*Attorney, Agent, or Firm*—Rothwell, Figg, Ernst & Kurz

[57] ABSTRACT

A self-adhesive label comprising a multilaminar label portion, a self-adhesive laminar material extending over, and adhered by its self-adhesive surface to, the multilaminar label portion thereby to form two self-adhesive edge portions thereof on opposed sides of the multilaminar label portion, a backing of release material to which one of the edge portions is releasably adhered and an unadhesive portion which is located on the rear surface of the said one edge portion.

6 Claims, 1 Drawing Sheet

LABELS AND MANUFACTURE THEREOF

FIELD OF THE INVENTION

The present invention relates to a self-adhesive label and to a method of producing a succession of self-adhesive labels carried on a backing of release material.

BACKGROUND OF THE INVENTION

A number of self-adhesive multilaminar labels are known. These labels can suffer from the disadvantage that they can be difficult for a user to open when the self-adhesive label is adhered to a product.

The present invention aims to provide a convenient and elegant solution to this problem.

SUMMARY OF THE INVENTION

Accordingly, the present invention provides a self-adhesive label comprising a multilaminar label portion, a self-adhesive laminar material extending over, and adhered by its self-adhesive surface to, the multilaminar label portion thereby to form two self-adhesive edge portions thereof on opposed sides of the multilaminar label portion, a backing of release material to which one of the edge portions is releasably adhered by a self-adhesive rear surface thereof and an unadhesive portion which is located on the rear surface of the said one edge portion.

The present invention also provides a method of producing a succession of self-adhesive labels carried on a backing of release material, the method comprising the steps of:

(a) releasably adhering a succession of multilaminar label portions to a backing of release material;

(b) either before, during or after step (a) applying a succession of patches of non-adhesive material to the backing of release material, (c) applying a self-adhesive laminar material over the succession of multilaminar label portions and patches on the backing of release material, the laminar material being adhered thereto by the self-adhesive surface thereof; and (d) cutting through the laminar material and the multilaminar label portions thereby to form the self-adhesive labels, each self-adhesive label including an edge portion of the laminar material having a respective one of the said patches which is unadhered to the backing of release material.

BRIEF DESCRIPTION OF THE DRAWINGS

An embodiment of the present invention will now be described by way of example only with reference to the accompanying drawings, in which.

DETAILED DESCRIPTION OF THE INVENTION

Figure 1:
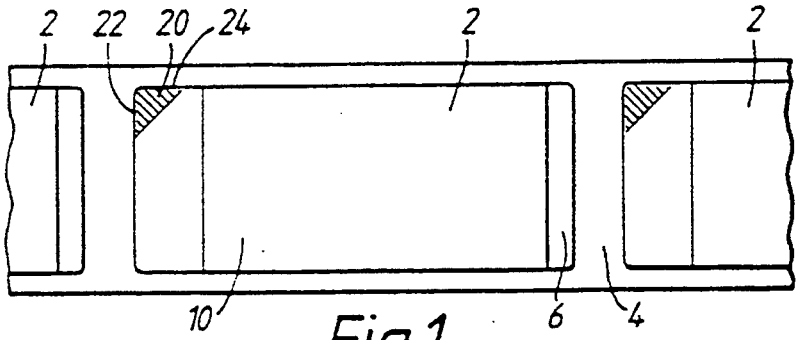
FIG. 1 is a plan view of a succession of labels in accordance with a first embodiment of the present invention when carried on the backing of release material.
Figure 2:
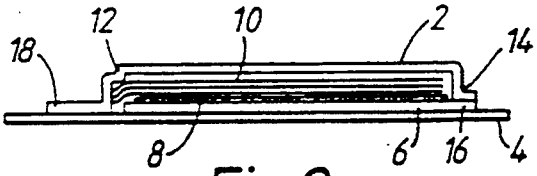
FIG. 2 is an elevational view of a label of FIG. 1 when carried on a backing of release material.

Referring to FIG. 1, there is shown a succession of self-adhesive labels 2 in accordance with a first embodiment of the present invention when carried on a backing 4 of release material. As is shown more clearly with reference to FIG. 2, each label 2 comprises a support piece 6 which is self-adhesive, the support piece being coated on its rear surface with a layer of pressure-sensitive adhesive which is releasably carried on the backing 4 of release material. A major portion, apart from a transverse edge, of the upper surface of the support piece 6 is coated with a layer 8 of adhesive, such as a water-soluble or hot melt adhesive, and the layer 8 of adhesive adheres to the support piece 6 a muitilaminar label 10, such as a booklet. The layer 8 may be applied as extruded beads or as a whole surface coat. A self adhesive laminar material 12, such as a clear plastics material, has a self-adhesive rear surface and the laminar material 12 is adhered by its self-adhesive surface over the support piece 6 and the label 10 thereby to constitute the entire front surface of the label 2. A portion 14 of the laminar material 12 is adhered to the transverse edge 16 of the support piece 6 which is not covered by the label 10. At the other transverse edge of the label 2 the laminar material 12 includes an edge portion 18 which is adhered by its self-adhesive Surface directly to the backing 4 of release material. Referring again to FIG. 1, a corner of the edge portion 18 of the laminar material 12 is coated on its rearwardly-directed self-adhesive surface with a patch of ink 20. The patch of ink 20 extends as far as the free edge 22 of the laminar 12 and acts to define an unadhered flap 24 which is not self-adhesive.

In use, the label 2 is removed from the backing 4 of release material and adhered to a product by the self-adhesive rear surface of the support piece 6 and the self-adhesive surface of the edge portion 18 of the laminar material 12. When it is desired to open the multilaminar label 10, a user manually pulls the unadhered flap 24 to release the edge portion 18 from the product.

The provision of a patch of ink on the rearwardly directed surface of the edge portion is a neat and convenient solution to enable a user readily to identify which portion of the label requires pulling in order to be able to open the label and also provides a flap which is unadhered to the product.

Figure 3:
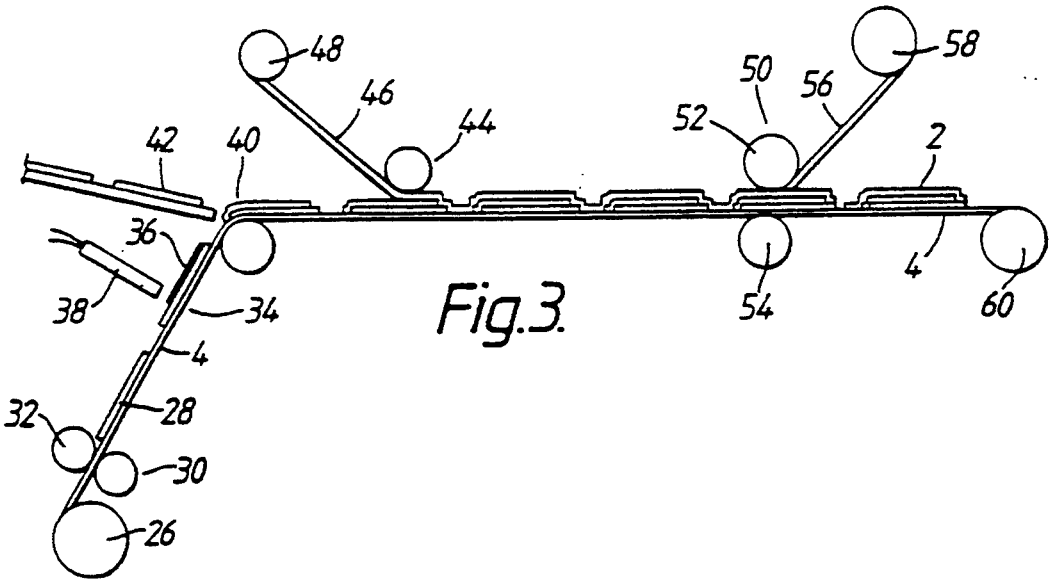
FIG. 3 schematically illustrates a method of manufacturing the labels of FIG. 1.

Referring to FIG. 3 there is shown schematically an apparatus for using a method for making labels in accordance with the first embodiment of the present invention. There is provided a reel 26 of a backing 4 of release material carrying thereon a succession of die-cut support pieces 28. The backing 4 of release material with the support pieces 28 releasably adhere thereon is passed to an ink applying station 30 at which patches of ink 20 are successively applied to the upper surface of the backing 4 of release material. The printing station 30 may typically comprise printing rollers 32. The web then passes to an adhesive applying station 34 at which an adhesive layer 36 is applied to the upper surface of the support pieces 28 by an adhesive applicator 38. The web then passes to a label applying station 40 at which a succession of labels 42 is applied to a respective succession of adhesive layers 36 and then the composite assembly is passed to a laminar material applying station 44 at which a web of self-adhesive laminar material 46 is fed out from a reel 48 thereof and applied over the top of the assembly. The combined assembly then passes to a die-cutting station 50 comprising a die-cutting roller 52 and a backing roller 54. At the die-cutting station 50, the die-cutting roller 52 cuts through the laminar material 46, the applied labels 42 and the support pieces 28 thereby to cut out the resultant labels 2 shown in FIGS. 1 and 2 and the waste web remnant 56 is removed and taken up on a reel 58. The labels 2 carried on the backing 4 of release material are then taken up on a storage reel 60.

Figure 4:
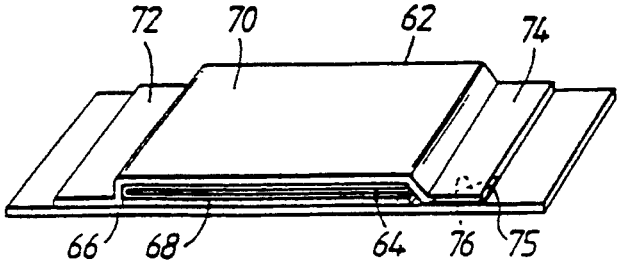
FIG. 4 is a perspective plan view of a label in accordance with a second embodiment of the present invention.

A further embodiment of a label in accordance with the present invention is illustrated in FIG. 4. In this embodiment, the support piece is omitted. The self-adhesive label 62 comprises a multilaminar label 64 which is adhered directly to a backing 68 of release material by a layer 68 of pressure-sensitive adhesive. The layer 68 of pressure-sensitive adhesive may be either in the form of extruded beads or as a whole surface coating. A self-adhesive laminar material 70 extends over both transverse edges of the multilaminar label 64 and the laminar material 70 is adhered by its self-adhesive rearwardly directed surface at two opposed edge portions 72, 74 thereof to the backing 66 of release material. A corner flap portion 75 of the rearwardly directed surface of the edge portion 74 is coated with a patch of ink 76 which renders the patch non-adhesive. When the self-adhesive label 62 is adhered to a product, the body of the label is adhered to the product by the adhesive layer 68 and the edges of the label 62 are adhered to the product by the edge portions 72, 74. The edge portion 74 can readily be pulled away from the product by manual grabbing of the corner flap portion 75 which is formed by the patch of ink 76.

I claim:

1. A self-adhesive label comprising:

a self-adhesive support piece which is carried on a backing of release material;

a multilaminar label portion which is adhered to the support piece; and a self-adhesive laminar material extending over, and adhered by its self-adhesive surface to, the multilaminar label portion thereby to form two self-adhesive edge portions thereof on opposed sides of the multilaminar label portion, one of the edge portions being releasably adhered to the backing of release material and the edge portion other than the said one edge portion being adhered to a front surface of the support piece and an unadhesive portion which is located on the rear surface of the said one edge portion.

2. A self-adhesive label according to claim 1 wherein the unadhesive portion comprises a patch of non-adhesive material which coats the self-adhesive surface of the laminar material.

3. A self-adhesive label according to claim 2 wherein the patch is comprised of ink.

4. A method of producing a succession of self-adhesive labels carried on a backing of release material, the method comprising the steps of:

(a) releasably adhering a succession of multilaminar label portions to a respective succession of self-adhesive support pieces carried on a backing of release material;

(b) either before, during or after step (a) applying a succession of patches of non-adhesive material to the backing of release material;

(c) applying a self-adhesive laminar material over the succession of multilaminar label portions, support pieces and patches on the backing of release material, the laminar material being adhered thereto by the self-adhesive surface thereof; and (d) cutting through the laminar material, the multilaminar label portions and the support pieces thereby to form the self-adhesive labels, each self-adhesive label including an edge portion of the laminar material which is releasably adhered to the backing of release material, and has a respective one of the said patches which is unadhered to the backing of release material, and another edge portion of the laminar material which is adhered to a respective support piece.

5. A method according to claim 4 wherein the patch is printed onto the backing of release material.

6. A method according to claim 5 wherein the patch is composed of ink.

* * * * *

UNITED STATES PATENT AND TRADEMARK OFFICE

CERTIFICATE OF CORRECTION

PATENT NO. : 5,399,403

DATED : March 21, 1995

INVENTOR(S) : David J. Instance

It is certified that error appears in the above-indentified patent and that said Letters Patent is hereby corrected as shown below:

Column 2, line 23, "Surface"should read--surface--.

Signed and Sealed this

Twenty-second Day of August, 1995

Bruce Lehman

*Attest:*

BRUCE LEHMAN

*Attesting Officer*

*Commissioner of Patents and Trademarks*